United States Patent [19]

Pittasch

[11] 4,122,581

[45] Oct. 31, 1978

[54] FURNITURE HINGE

[75] Inventor: Willi Pittasch, Herford, Fed. Rep. of Germany

[73] Assignee: Richard Heinze, Fed. Rep. of Germany

[21] Appl. No.: 690,526

[22] Filed: May 27, 1976

[51] Int. Cl.[2] ..... E05D 5/02

[52] U.S. Cl. ..... 16/158

[58] Field of Search ..... 16/169, 170, 171, 128 R, 16/135, 158

[56] References Cited

U.S. PATENT DOCUMENTS

| | | | |
|---|---|---|---|
| 1,145,521 | 7/1915 | Stock | 16/158 |
| 3,042,962 | 7/1962 | Fredrieksen | 16/158 |
| 3,604,154 | 9/1971 | Curran | 16/135 X |
| 3,766,599 | 10/1973 | Ullman | 16/171 |

*Primary Examiner*—Doris L. Troutman

*Attorney, Agent, or Firm*—Harris, Kern, Wallen & Tinsley

[57] ABSTRACT

A hinge for mounting a door in an opening of a piece of furniture, with a hinge part receiving a door between spaced arms with an arm visible on the door outside face when the door is closed, and with a holding component having a flat bracket for attachment to an interior face of the furniture, and with the holding component pivotally mounted to the hinge part.

19 Claims, 9 Drawing Figures

Fig. 1
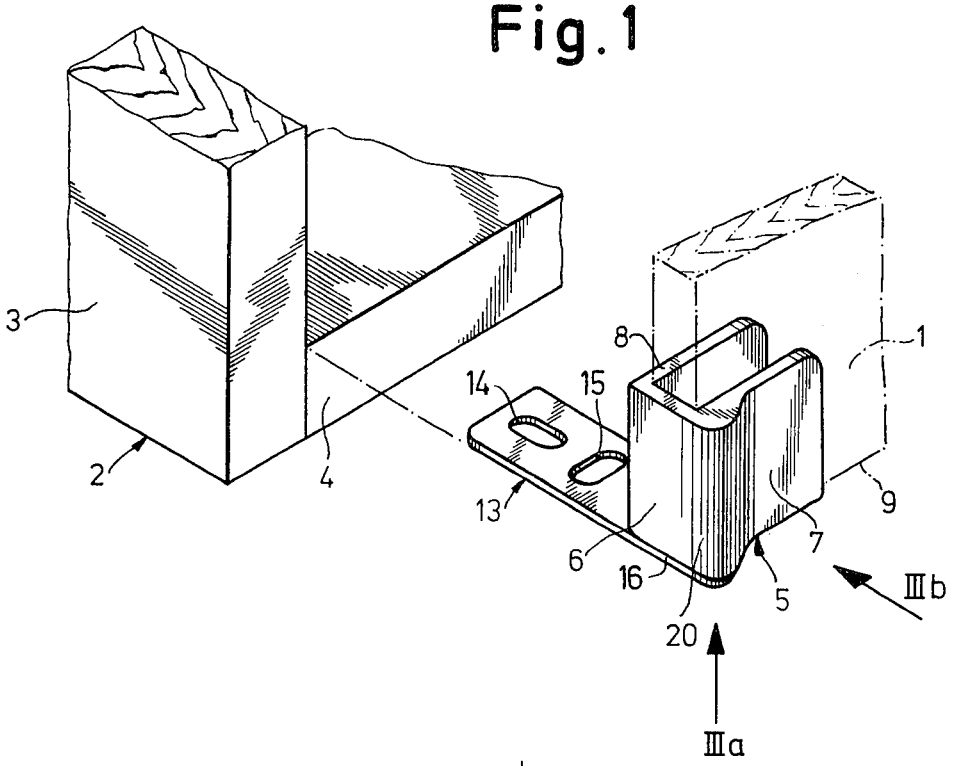
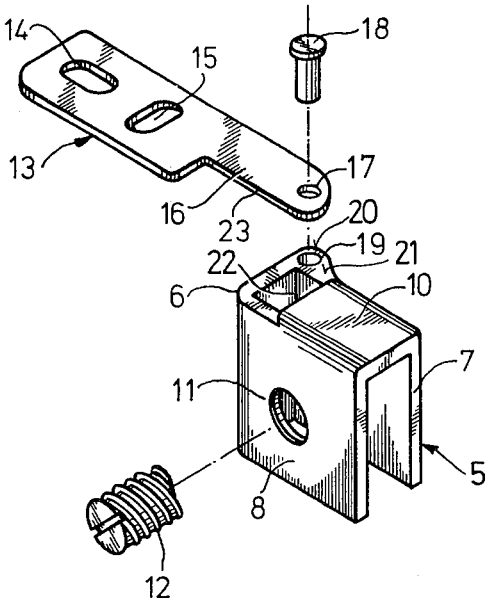
Fig. 2

Fig. 3a
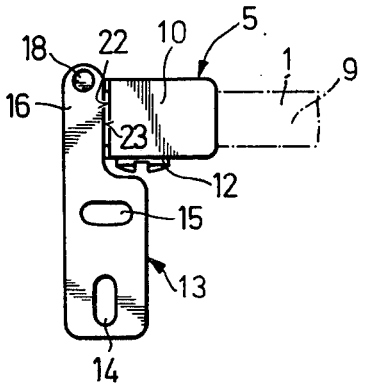
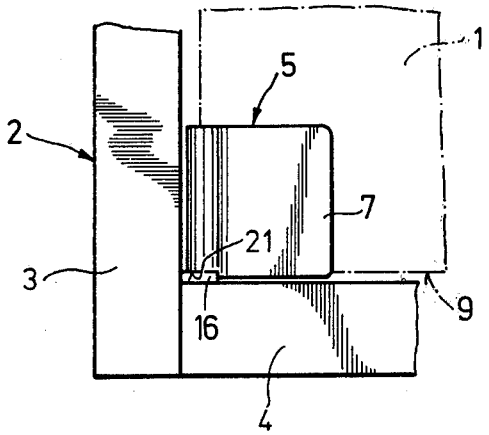
Fig. 3b

FURNITURE HINGE

The invention refers to a hinge for pivoting a furniture door on a furniture body, consisting of hinge parts which rest visibly on the door outside surfaces when the door is closed as well as of the holding part or arm fastened inside the furniture body and pivoting on the hinge part.

Previously there was a tendency in the furniture making industry to use for pivoting of furniture hinges on a furniture body, hinges which were at least invisible when the door was closed and in which the pivoting system consisted preferably of four pivoting pins and of two levers. However, at present hinges which also remain visible when the door is closed are once again increasingly used, so that hinges of this kind can be used as design features in creating the aesthetic overall impression of the furniture.

Visible hinges of the kind described above are known. However, they are not always able to meet the demands imposed on the modern hinge or funiture production methods. In particular the known hinges of this kind have the disadvantage that as a rule they require a fastening for the hinge parts on the narrow edge of a furniture door or of a furniture body, which results in problems with regard to the mechanical strength of the anchoring of the hinge component to the relevant furniture components and, moreover, they are very complicated in their design as well as in the fitting on the furniture body or on the furniture door. In particular the hinges which are used for glass doors generally require special openings in the doors for fastening of the hinge components specified for these locations which makes the production of glass doors of this type very expensive.

The objective of the present invention is now to improve a hinge of the above described type in such a manner that these disadvantages of known hinges will not occur and that secure fastening of the hinge components on the furniture together with simple adjustment of the hinge or of the hinge pivoting pins is ensured especially by simple forming and design of the furniture components, especially of the furniture door without disturbing the aesthetic overall impression which is aimed at on using visible hinges.

In order to solve this problem a hinge of the above described kind is designed according to the invention in such a manner that the holding part has a flat bracket which runs across or at right angles to the door rotating axis. This bracket is pivoted on the end face of the hinge part and the hinge part 5, 5', 5'' rests at least against one end face of the furniture door 1, 1', 1''.

The advantage of the invention is that by a simple design all components of the hinge as well as the hinge part, in addition to the holding component can be fastened in a simple manner on the surface of the furniture door or of the furniture body. An additional advantage is that by means of the holding component or by means of a corresponding fastening of this holding component on the furniture body, the adjustment of the pivot pin between the holding component and the hinge part fastened on the furniture door relative to the furniture body is simple to carry out, so that even in the case of tolerances, for example in the production of the furniture, the correct rotation of the furniture door is guaranteed. The invention makes it possible, moreover, that in the case of furniture which is delivered in compact form, for reducing transport volume, by the furniture maker to the user, the holding component is already fitted by the maker on a furniture wall, for example on a furniture floor or a furniture side wall and the hinge part is also already fitted on the furniture door by the furniture maker, whereby the end user carries out the fastening of the furniture door on the furniture body by simply connecting the already fitted hinge part with the corresponding, also previously fitted holding component, for example, by insertion of the single fastening screw.

The hinge according to the invention is especially suitable for guiding and rotating of what are known as "sunk" furniture doors, i.e. for furniture doors, which, on closing, move into the opening of the furniture body. In this case the holding component fastened within the furniture body reaches with its flat, strip shaped bracket through a gap between the door edge which runs across or at right angles to the door rotating axis and the adjacent wall of the furniture body to the door outside surface and there it is pivoted on the hinge part held on the door. Since the bracket of the holding component is very narrow at the end which it is connected with the hinge part and also very thin, it therefore does not disturb the eye when the door is closed.

In a version of the invention the hinge component consists of a U shaped profile, whose arms are additionally connected to each other by a stiffening web and a pocket shaped opening is formed by the arms as well as the stiffening web and the corner of a door can be fitted into this opening. In this case the furniture door is fastened into the pocket shaped opening either by adhesive bonding or by clamping, for example by using a clamping screw or other clamping means. This version, which uses the hinge part which encloses the door as a clamp and as a U shaped profile, has the advantage that it is not necessary to have openings in the door for fastening the hinge part, which is especially advantageous in the case of glass doors. Further versions of the invention are described in the subsidiary claims.

The invention is described and explained in greater detail below, will various embodiments illustrated in the drawings. In the drawings, FIG. 1 is a perspective exploded view of a first version of the hinge according to the invention, together with a sectional part view of the furniture door as well as of the furniture body;

FIG. 2 is a perspective exploded view of the hinge of FIG. 1;

FIG. 3*a* is a plan view of the hinge of FIG. 1;

FIG. 3*b* is a view of the front side of the furniture body together with the hinge of FIG. 1;

Figure 4:
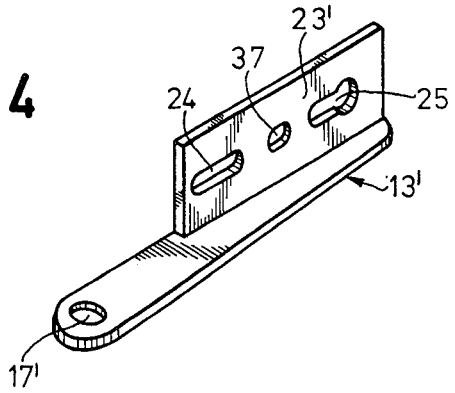
FIGS. 4 and 5 are perspective views of additional versions of the holding component of the hinge.

All of the above described versions have a common feature that the furniture door rests against the hinge part by the end face which is at right angles to the hinge rotating axis as well as by the end face which is parallel to the hinge rotating axis. This arrangement ensures an especially secure fastening. In FIGS. 1, 2, 3*a* and 3*b* the component 1 is a furniture door which is to be fastened with the hinge according to the invention to a furniture body 2 so that it is able to rotate. The furniture door 1 as well as the furniture body 2 are shown only in part section in FIGS. 1 and 3*b* and only the lower hinge side corner of the furniture body 2 is shown, which is formed by the furniture side wall 3 as well as by the furniture floor 4.

The hinge consists basically of the hinge part 5 which encloses the lower hinge side corner of the furniture door 1 as a clamp. The hinge part 5 consists of two arms 7 and 8 which are connected by a yoke 6 and these arms are both parallel to the side faces of the furniture door 1. On the door lower edge 9 which is at right angles to the door rotating axis the arms 7 and 8 in the version shown are connected to each other by an additional stiffening web 10 (FIGS. 2, 3*a* and 3*b*), so that the arms 7 and 8 together with the yoke and the stiffening web form a pocket shaped opening for the corner of the furniture door 1. The door is held in the pocket shaped opening either by clamping fit or by adhesive bonding; however, it is also possible to provide on the arm 8 which rests on the door inner side, a through tapped hole 11 for a screw or for a grubscrew 12, which, on insertion, rests against the inside face of the furniture door 1 and presses this against the arm 7. The hinge part 5 consists preferably of a plastics material; if this hinge part is made from metal, then it is recommended, in the case of a glass door 1, to provide between this glass door and the arms 7 and 8 an intermediate layer made from a flexible material, for example plastics, in order to prevent damage to the glass door 1 and to achieve a uniform contact pressure.

On the inside of the furniture floor 4 is fastened a flat, strip shaped holding component 13, which is arranged parallel to the corner formed by the furniture side wall 3 and by the furniture floor. The fastening is carried out by means of holding and fastening screws not described here in detail, which are pressed through the slots 14 and 15 on the wider end of the holding component 13 and through it into the furniture floor 4. The slots 14 and 15 make it possible to carry out a positional adjustment of the holding component 13 relative to the furniture body 2 within certain limits in order to compensate in this manner the production tolerances of the furniture body 2 or of the furniture door 1 as well as on fastening of the hinge part 5 on the furniture door 1 and in order to ensure the desired rotating movement of the furniture door 1.

At its free end, i.e. at the end remote from the slots 14 and 15, the holding component 13 has reduced width or a bracket 16 of reduced width, which is provided at its end with a hole 17 for a pin 18, (FIG. 2). The pin 18 which forms the pivoting pin of the hinge engages through the hole 17 of the bracket 16 of the holding component 13 into a hole 19 of the hinge part 5 and it is fastened there in a suitable manner. This fastening can be carried out for example by providing the pin 18 at least partly with a screw thread which can be screwed into an internal screw thread of the hole 19. The pin 18 can, however, also be held in other ways. Hence, for example, it is possible to fasten the pin 18 on the holding component 13 by welding or by making it integrally with the holding component 13.

The hole 19 is parallel to the surface side of the arm 7 or parallel to the surface of the furniture door 1 and at right angles to the stiffening web 10 and it is situated in the direct vicinity of the connection positions between the arm 7 and the yoke 6, in which case the arm 7 is thickened on its outside face. As well as providing the aesthetic visual design of the furniture hinge part 5, this bead shaped thickening rib 20 also provides the necessary position in the arm 7 for the hole 19 and it also ensures that this arm 7 will have the necessary mechanical strength for tightening of the screw 12.

As shown especially by FIGS. 1, 3*a* and 3*b* the hinge shown is used for pivoting what is known as a "sunk" furniture door 1, i.e. it is used for guiding and rotating a furniture door which on closing moves completely into the door opening of the furniture body 2. In order to achieve the rotating movements required in this case for the furniture door 1 the rotating pivot pin formed by the pin 18 for the hinge is situated in front of the outside face of the furniture door 1 or in the direct vicinity of this outside surface (FIGS. 3*a*), whereby, when the furniture door is closed, the holding component 13 projects with its bracket 16 from within the furniture body through a gap between the door edge 9 and the inside surface of the furniture floor 4 to the furniture body front side or to the outside surface of the furniture door 1.

An opening 21 (FIG. 3*b*) is provided for the bracket 16 on the underside or end face of the hinge part 5 connected by a pivot to this bracket. This opening is fully occupied by the bracket when the door is closed (FIG. 3*a*) and is formed by the arrangement that the stiffening web 10 does not reach to the yoke 6. The edge of the opening 21 formed by the end face 22 of the stiffening web 10 rests against the side face 23 of the bracket 16 when the door is closed and it hence restricts the closing movement of the furniture door 1 (FIG. 3*a*).

In the version shown in FIGS. 1, 2, 3*a* and 3*b* the thickness of the holding component 13 or of the bracket 16 is approximately equal to the thickness of the stiffening web 10 and moreover the hinge part 5 is fastened on the furniture door 1 in such a manner that the arms 7 and 8 are aligned approximately in the region of the opening 21 with the edge 9 of the furniture door 1. In this manner it is achieved that when the furniture door 1 is closed, the end of the bracket 16 provided with the hole 17 visually forms a supplement to the hinge part 5 or to the stiffening web 10 and hence it does not become noticeable to the eye in a disturbing manner, which is especially useful when the end of the bracket 16 provided with the hole 17 is rounded and this rounding matches the curvature of the thickened rib 20. In addition to an aesthetically attractive outside design, corners or angles which are difficult of access and into which dirt could collect are prevented by this means.

It is obvious that a hinge of this kind can also be provided for the upper corner of the furniture door 1, and in this hinge the hinge part 5 has the stiffening web 10 and the hole 19 as well as the opening 21 on the other side of the arms 7 and 8. The holding component 13 can be used, by simple rotation, equally well for a hinge on the upper edge, as well as for a hinge on the lower edge of the furniture door 1. This considerably reduces the cost of stocking and of manufacturing the holding component 13.

FIG. 4 shows a holding component 13', which is not fastened, as in the case of the holding component 13 in FIGS. 1, 2, 3*a* and 3*b*, on the inside face of a furniture floor or a furniture wall which is at right angles to the door rotating axis, but on the furniture inside surface which is parallel to the door rotating axis, for example on the furniture side wall 3. For this purpose the holding component 13′ is provided with an angle plate 23′, which has slots 24 or keyhole shaped holes 25 for the holding screws which are inserted into the furniture side wall 3.

Figure 5:
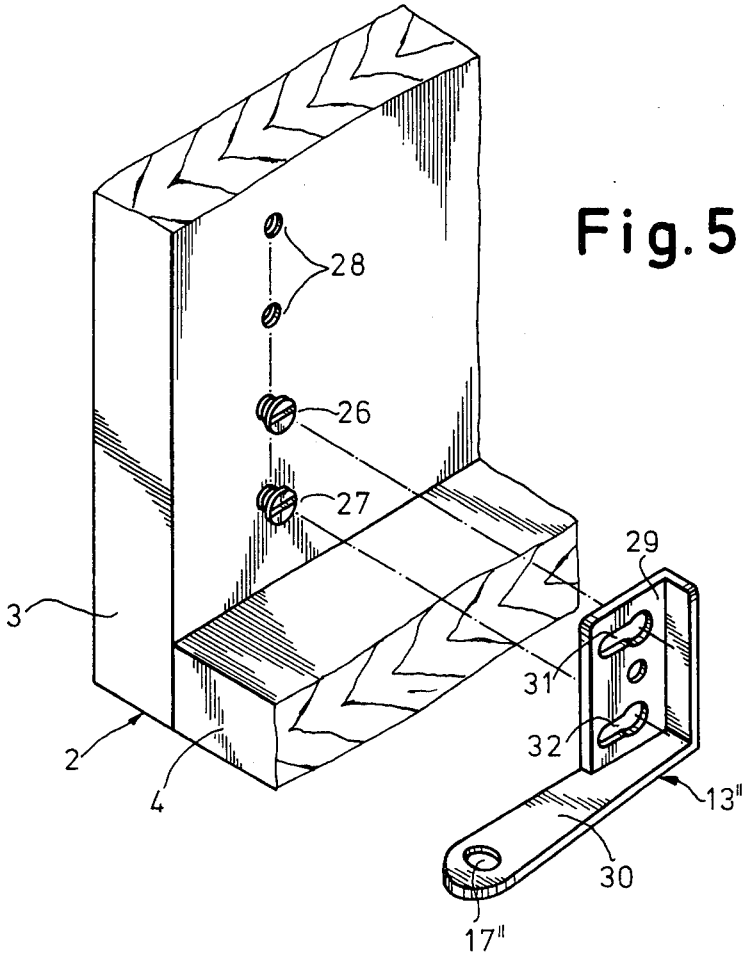

Similar to the above is the design of the holding component 13″ shown in FIG. 5, which is to be fastened by means of screws 26 and 27, which engage with the prepared holes 28 in a row of holes provided on the furniture side wall 3. For this purpose the holding component 13″ is provided with an angle plate 29, which has preferably keyhole shaped holes 31 and 32, above each other, for the holding screws 26 and 27 in the direction at right angles to the corner formed by this angle plate 29 and the bracket 30 of the holding component 13″.

Figure 6:
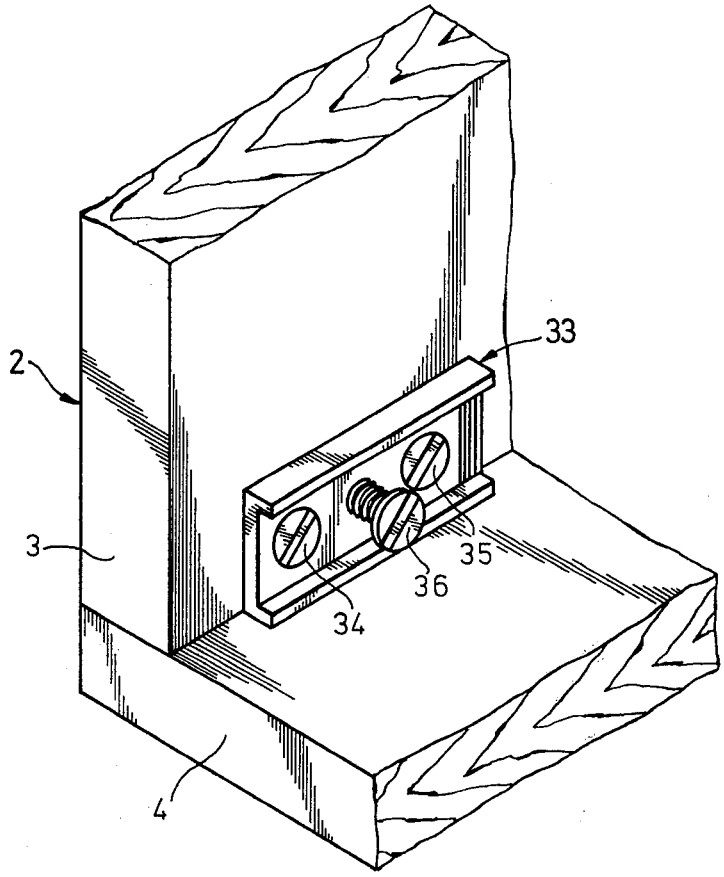
FIG. 6 is a perspective view of a holding or adjusting plate for the holding component together with a partial section of the furniture body.

FIG. 6 shows a holding or adjusting plate 33, which is fastened with its own screws 34 and 35 on the furniture side wall 3 and on which for example the component 13′ shown in FIG. 4 can be fastened adjustably, by means of a fixing screw 36, and the holding component 13′ is enclosed by the arms of the U shaped or trough shaped holding or adjusting plate so that it cannot rotate. The fastening screw 36 passes in this case through a hole 37 in the angle plate 23′ of the holding component 13′, in which the hole 37 is also arranged preferably as a slot for adjusting purposes.

Figure 7:
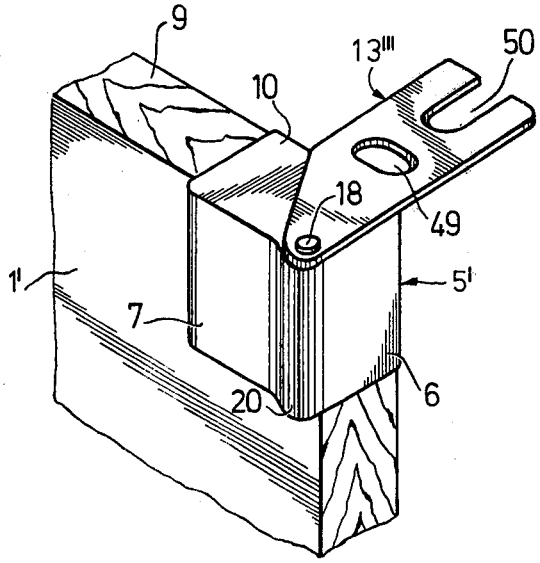
FIG. 7 is a perspective view of a further version of the hinge of the invention together with a partial view of a furniture door.

The version shown in FIG. 7 of the hinge according to the invention consists of a holding component 13‴, which once again is fastened on the inside surface of the furniture body on a surface which is at right angles to the door rotating axis, for example on the inside surface of the furniture floor or of the furniture top; it has also a hinge part 5′ which corresponds basically to the hinge part 5 of the version according to FIGS. 1, 2, 3*a* and 3*b*. In the case of FIG. 7 the furniture door 1′ is made from timber which, as a rule, has greater thickness than a glass door, so that accordingly the arms of the hinge part 5′ which grip the furniture door 1′ in the form of clamps also have a larger distance between them than that between the arms 7 and 8 shown in the version in FIGS. 1–3*b*. Moreover, the hinge according to FIG. 7 differs from the previously described version by the fact that no opening 21 for the holding component 13‴ or its bracket is provided in the hinge component 5.

The holding component 13‴ has a slot 49 and a slot 50 used for its fastening, with the slot 50 open towards the free end of the holding component.

Figure 8:
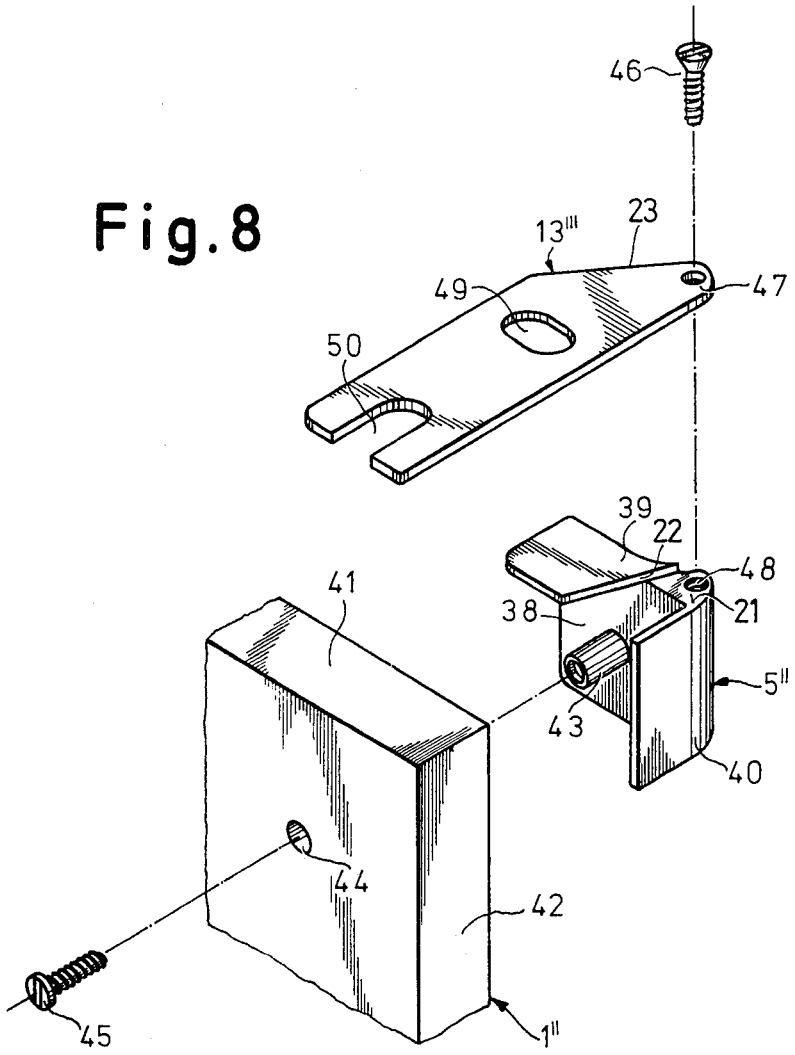
FIG. 8 is a perspective exploded view of another version of the hinge of the invention together with a partial sectional view of a furniture door.

A further version of the invention is shown in FIG. 8. A hinge part 5″ is fastened here on a timber or glass door 1″. The hinge part 5″ has in this case only one arm or one plate 38, each of which is in contact with the door front face and is provided with angle plates 39 or 40 which are at right angles to the plate 38 as well as at right angles to each other. In this case the plate 39 is parallel to the door upper edge which is at right angles to the door rotating axis or it is parallel to the corresponding door lower edge, while the angle plate 40 is parallel to the door rotating axis or parallel to the door edge 42.

A fastening pin 43 is formed on the plate 38 for fastening the hinge part 5″ to the furniture door 1″. This fastening pin 43 engages with the hole 44 in the furniture door 1″ and it can be anchored there by means of a fastening screw 45, which can be screwed into a hole in the pin 43 from the door inner side. It is obviously also possible to fasten the pin 34 by some other means, for example by adhesive bonding or by other means in the hole 44 in which the pin 43 is formed as an insertion pin and which has locking serrations on its outside circumference.

The holding component 13‴ is used once again for pivoted fastening of the hinge part 5″ on the furniture body. The holding component 13‴ is made from a flat strip material and it is arranged across the door pivoting axis. The holding component 13‴ or its free end is pivoted by means of the pin or screw 46, which passes through the hole 47 in the holding component 13‴ into a hole 48 of the hinge part 5″ and it is pivoted on this hinge part 5″ which in this version is also thickened in the form of a rib in the region of the hole 48.

The angle plate 39 does not reach over the whole width of the plate 38, so that an opening is once again formed on the hinge part 5″. In this case the free end of the holding component 13‴ moves into this opening at an angle when the furniture door 1″ is closed, and which, together with the holding component 13‴ provides a limitation restricting element for the door rotating movement in the door closing position, as described above in conjunction with the opening 21.

All the above described versions of the hinge according to the invention have the advantage that the holding components can be fitted in advance by the furniture maker to a furniture body and the hinge part can be preassembled on the furniture door, so that the fitting of the furniture door on the furniture body for the furniture, which is supplied by the furniture maker to the user in a compact form, for saving of transport space, is carried out in an especially simple manner by connection of the holding component with the associated hinge part by the pin or the screw 18 or 46 by the user. On using a holding or adjusting plate 33 it is also possible that only this holding or adjusting plate can be fitted on the furniture body whilst the other hinge components are provided on the furniture door.

What we claim as our invention is:

1. A hinge for pivoting and guiding a furniture door on a furniture body which encloses a space defined by walls and closed by a door, including in combination:

a first hinge member attachable to the inner surface of one of said walls of said furniture body inside said body and including a flat bracket which is disposed at right angle to a pivot axis at one end of said bracket; and a second unitary hinge member attachable to the furniture door and being pivotally connected to the bracket at said pivot axis by a pivot pin, said second hinge member being formed by a U-profile having two arms with one of said arms forming first wall means abutting the door outside face and visible when the door is closed, with said arms connected to each other by a yoke forming second wall means abutting a side face of the door, and with said two arms of said U-profile, which encloses the door in form of a clamp, being connected to each other additionally by a stiffening web forming third wall means at right angles to the first and to the second wall means.

2. A hinge as defined in claim 1, characterized in that when the furniture door is closed said bracket extends through a gap between one door edge which runs at right angles to said pivot axis and an adjacent furniture wall on the door outside surface and is pivoted there on said second hinge member.

3. A hinge as defined in claim 1, characterized in that said arms extend from said yoke at right angles to said pivot axis.

4. A hinge as defined in claim 1 including clamping means carried on one of said arms which clamping means rests on the door inside surface for pressing the furniture door against said other arm.

5. A hinge as defined in claim 1, characterized in that one of said arms is thickened in the region of its connection point with said yoke, and said pivot axis is situated in said region.

6. A hinge as defined in claim 1, characterized in that said second hinge member comprises a first wall means abutting against the outside face of the furniture door and two second wall means at right angles to said first wall means and also at right angles to each other.

7. A hinge as defined in claim 1 wherein said first wall means of said second hinge member includes bearing means for said pivot pin.

8. A hinge as defined in claim 1 wherein said second hinge member includes means for pressing said door against said first wall means.

9. A hinge as defined in claim 1, characterized in that said first hinge member including said bracket is made from a flat strip material for fastening on one wall of the furniture body, which wall is at right angles to the furniture door rotating axis.

10. A hinge as defined in claim 1, characterized in that said first hinge member has an angle plate for its fastening.

11. A hinge for pivoting and guiding a furniture door on a furniture body which encloses a space defined by walls and closed by a door, including in combination:

a first hinge member attachable to the inner surface of one of said walls of said furniture body inside said body and including a flat bracket which is disposed at right angle to a pivot axis at one end of said bracket; and a second hinge member attachable to the furniture door and being pivotally connected to said bracket at said pivot axis by a pivot pin;

said second hinge member having first wall means abutting the door outside face, which face is visible when the door is closed, and second and third wall means at right angles to said first wall means and also at right angles to each other, and having a recess for said bracket near said second and third wall means, with said recess matched to the shape of said bracket in such a manner that said recess is completely filled by said bracket when the furniture door is completely closed.

12. A hinge as defined in claim 11, characterized in that said second wall means includes a side face at said recess forming a stop for restricting the door rotating movement in the door closing position.

13. A hinge as defined in claim 11, characterized in that the depth of said recess is at least equal to the thickness of said bracket.

14. A hinge as defined in claim 11, characterized in that said second hinge member is formed by an U-profile with two arms, one of which forms said first wall means, and which are connected to each other by a yoke forming said second wall means, that a stiffening web is provided between said two spaced arms forming said third wall means, and that said stiffening web is spaced from said yoke for forming said recess.

15. A hinge for pivoting and guiding a furniture door on a furniture body which encloses a space defined by walls and closed by a door, including in combination:

a first hinge member attachable to the inner surface of one of said walls of said furniture body inside said body and including a flat bracket which is disposed at right angle to a pivot axis at one end of said bracket; and a secondary unitary hinge member attachable to the furniture door and including first wall means abutting the door outside face, which is visible when the door is closed, said secong hinge member having second wall means abutting a side fadce of said furniture door and having an edge face aligned with the door edge which is situated across the pivot axis, and with said bracket connected at said pivot axis by a pivot pin to said second hinge member at said edge face of said second hinge member.

16. A hinge for pivoting and guiding a furniture door on a furniture body which encloses a space defined by walls and closed by a door, including in combination:

a first hinge member attachable to the inner surface of one of said walls of said furniture body inside said body and including a flat bracket, which is disposed at right angle to a pivot axis at one end of said bracket; and a second unitary hinge member attachable to the furniture door and including first wall means abutting the door outside face, which is visible when the door is closed, said second hinge member having second wall means abutting a side face of said furniture door, and said pivot axis engaging a bore hole provided in said first wall means and running parallel to a surface by which said first wall means abut said door outside face.

17. A hinge for pivoting and guiding a furniture door on a furniture body, which encloses a space defined by walls and closed by a door, including in combination:

a first hinge member attachable to the inner surface of one of said walls of said furniture body inside said body and including a flat bracket which is disposed at right angle to a pivot axis at one end of said bracket; and a second unitary hinge member attachable to the furniture door and including first wall means abutting the door outside face, which is visible when the door is closed, said first hinge member having an angle plate including holes for fastening screws, and said holes being arranged on top of each other in a direction of right angles to a corner formed by said angle plate and said bracket of said first hinge member.

18. A hinge for pivoting and guiding a furniture door on a furniture body, which encloses a space defined by walls and closed by a door, including in combination:

a first hinge member attachable to the door inner surface of one of said walls of said furniture body inside said body and including a flat bracket which is disposed at right angle to a pivot axis at one end of said bracket;

a second unitary hinge member attachable to the furniture door and including first wall means abutting the door outside face, which is visible when the door is closed, with said second hinge member being pivotally connected to said bracket at said pivot axis by a pivot pin and having second wall means abutting a side face of said furniture door; and a holding and adjusting plate attachable to one of said walls within said furniture body, which plate receives said first hinge member so that said first hinge member cannot be rotated.

19. A hinge for pivoting and guiding a furniture door on a furniture body which encloses a space defined by walls and closed by a door, including in combination:

a first hinge member attachable to the inner surface of one of said walls of said furniture body inside said body and including a flat bracket which is disposed at right angle to a pivot axis at one end of said bracket;

a second unitary hinge member attachable to the furniture door and being pivotally connected to the bracket at said pivot axis by a pivot pin, said second hinge member having first wall means abutting the door outside face, which is visible when the door is closed, with the second hinge member having further second wall means abutting a side face of the furniture door, and further having third wall means abutting a further side face of the furniture door, said second and third wall means being at right angles to said first wall means and to each other, and a pin being provided on said first wall means for insertion into a hole of the furniture door.

* * * * *